US007665580B2

(12) United States Patent
Stocker et al.

(10) Patent No.: US 7,665,580 B2
(45) **Date of Patent: *Feb. 23, 2010**

(54) EQUIPMENT FOR SUSPENSION OF A CAR OR COUNTER WEIGHT IN AN ELEVATOR INSTALLATION AND METHODS FOR MOUNTING AND FOR MAINTENANCE OF SUSPENSION MEANS

(75) Inventors: Ruedi Stocker, Buchrain (CH); Christoph Liebetrau, Menziken (CH); Miriam Schmid, Lucerne (CH)

(73) Assignee: Inventio AG, Hergiswil NW (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/181,068

(22) Filed: Jul. 14, 2005

(65) Prior Publication Data

US 2006/0175139 A1 Aug. 10, 2006

(30) Foreign Application Priority Data

Jul. 17, 2004 (EP) ..... 04016912

(51) Int. Cl.
*B66B 11/08* (2006.01)
*B66B 7/08* (2006.01)

(52) U.S. Cl. ..... 187/266; 187/411

(58) Field of Classification Search ..... 187/251, 187/266, 411, 412

See application file for complete search history.

(56) References Cited

U.S. PATENT DOCUMENTS

| | | | | |
|---|---|---|---|---|
| 1,957,724 | A * | 5/1934 | Otto | 187/411 |
| 3,052,320 | A * | 9/1962 | Dardy | 187/411 |
| 3,519,101 | A * | 7/1970 | Sieffert | 187/256 |
| 4,537,286 | A * | 8/1985 | Morris et al. | 187/412 |
| 5,149,922 | A * | 9/1992 | Kondou | 187/392 |
| 5,490,577 | A * | 2/1996 | Yoo | 187/252 |
| 5,533,595 | A * | 7/1996 | Narumi et al. | 187/266 |
| 5,957,243 | A * | 9/1999 | Root et al. | 187/266 |
| 6,123,176 | A * | 9/2000 | O'Donnell et al. | 187/393 |
| 6,341,669 | B1 * | 1/2002 | St. Pierre et al. | 187/412 |
| 6,471,012 | B2 * | 10/2002 | Faletto | 187/256 |
| 6,598,707 | B2 * | 7/2003 | Nakagaki et al. | 187/266 |
| 6,820,726 | B1 * | 11/2004 | Ericson et al. | 187/411 |
| 7,077,241 | B1 * | 7/2006 | Liebetrau et al. | 187/266 |
| 2004/0108170 | A1 * | 6/2004 | Kocher et al. | 187/254 |
| 2005/0087404 | A1 * | 4/2005 | Barrett et al. | 187/411 |

FOREIGN PATENT DOCUMENTS

| | | |
|---|---|---|
| DE | 23 33 120 | 1/1975 |

(Continued)

*Primary Examiner*—John Q Nguyen
*Assistant Examiner*—Eric Pico
(74) *Attorney, Agent, or Firm*—Fraser Clemens Martin & Miller LLC; William J. Clemens

(57) ABSTRACT

Equipment for suspension of a car or a counterweight in an elevator installation and methods for mounting and for maintenance of the suspension apparatus includes deflecting roller units. The car or the counterweight hangs at support belts that are each connected with the car or the counterweight by an associated one of the deflecting roller units. Each roller unit provides space for one of the support belts. The roller unit provides compensation for different elongations of the several support belts and it enables simple mounting of the support belts.

5 Claims, 6 Drawing Sheets

FOREIGN PATENT DOCUMENTS

| | | | | |
|---|---|---|---|---|
| EP | 1 052 212 | A1 | | 11/2000 |
| EP | 1052212 | A1 | * | 11/2000 |
| EP | 1 400 477 | | | 3/2004 |
| JP | 52 071043 | | | 6/1977 |
| JP | 02013589 | | | 1/1990 |
| JP | 02013589 | A | * | 1/1990 |
| JP | 9-21677 | A | | 8/1997 |

* cited by examiner

EQUIPMENT FOR SUSPENSION OF A CAR OR COUNTER WEIGHT IN AN ELEVATOR INSTALLATION AND METHODS FOR MOUNTING AND FOR MAINTENANCE OF SUSPENSION MEANS

BACKGROUND OF THE INVENTION

The present invention relates to equipment for suspension of a car or a counterweight in an elevator installation and to methods for mounting and for maintenance of such suspension means.

German patent document DE 2333120 illustrates such an elevator installation, in which a car and a counterweight are suspended by means of looping around of steel belts. Several deflecting rollers are in that case combined into a deflecting roller unit, which is connected with the car or with the counterweight. The individual deflecting rollers are in that case arranged on a common axis so that the individual deflecting rollers are capable of different rotation.

However, this solution has disadvantages. The deflecting roller units have to be matched to the number of steel belts that are used and be correspondingly combined. Alignment of the deflecting roller unit to the take-off direction of the belts can take place only as a whole and an individual length compensation of the belts due to unequal load distribution, aging and wear or imprecise mounting is not possible with this deflecting roller unit.

SUMMARY OF THE INVENTION

An object of the present invention is to provide equipment that eliminates the aforesaid disadvantages. Compensation for different support belt elongation and adjustment of the deflecting rollers to special arrangements, for example of the counterweight, shall be made possible.

The present invention relates to equipment for the suspension of a car or counterweight in an elevator installation and to methods for mounting and for maintenance of suspension means, wherein the car or the counterweight hangs at support belts and the support belts are connected with the car or counterweight by means of several deflecting rollers.

According to the present invention the equipment for suspension of a car or a counterweight is constructed in such a manner that each deflecting roller is installed in an associated deflecting roller unit, each deflecting roller unit offers space for an individual support belt and each support belt is connected by the associated deflecting roller unit with the car or with the counterweight.

The advantage of this invention is that each deflecting roller unit is associated with one support belt. Preparation of the deflecting roller unit for a specific order is thereby possible in simple manner, since the number of deflecting roller units corresponds directly to the number of support belts. Moreover, the equipment is suitable for use in modernization of existing elevator installations. Modernization consists of parts of an existing elevator installation that are partly or entirely replaced. A typical modernization approach consists in replacing an old drive system. Old elevator installations or the drive systems thereof were often provided with direct suspension and support cables were as a rule used as support means. A new drive system preferably operates with looped suspension and with support belts. The drive system can thereby be operated with low torques and correspondingly low motor current, which enables use of more economic subassemblies. The equipment according to the present invention for suspension of car or counterweight is best suited to this purpose since it has small dimensions and is connectable in an ideal manner with existing cars or counterweights. A further advantage results from the direct usability of the deflecting roller unit for mounting the support belt in an elevator installation. This facilitates the mounting process.

The deflecting roller unit is, in an advantageous embodiment, individually adjustable. It can accordingly be used for compensation for length change of the support belt. The use of a tie bolt for connecting the deflecting roller unit with the car or with the counterweight enables each individual deflecting roller unit to be able to be adjusted to a required take-off direction of the support belt. By take-off direction there is understood the direction which corresponds with the resultant force line resulting from the force sum of the support belt running to and running from the deflecting roller unit.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
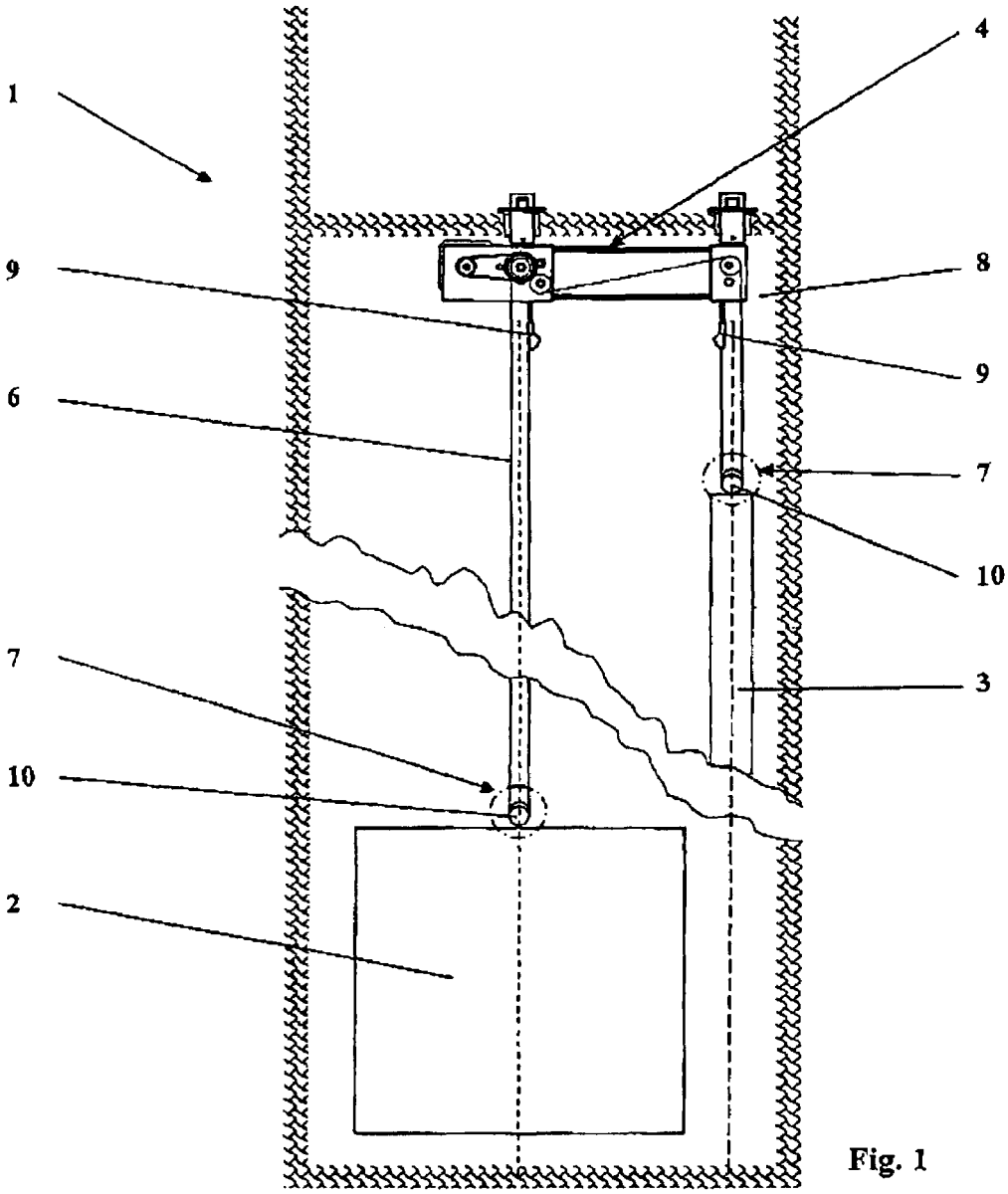
FIG. 1 is a schematic cross-sectional elevation view of an elevator installation with a suspended car and counterweight according to the present invention.

FIG. 1 shows an arrangement, by way of example, of an elevator installation 1 with a loop-suspended car 2 and counterweight 3. Support means 6 are in that case fastened in the region of a shaft head 8 or directly to a drive unit 4 by means of a support means end fastening 9. The support means 6 runs in a first section to a suspension 7 of the car, which is arranged on the car 2 and is guided in a second section from the car 2 to a driving or deflecting pulley of the drive unit 4. A third section of the support means 6 further leads from the drive unit 4 to a suspension 7 which is arranged at the counterweight 3 and from the counterweight 3 in turn to a support means end fastening 9 at the counterweight side. The support means 6 is formed by a support belt. The cross-section of the support belt 6 is flat, wherein the surface serving for traction can be smooth or shaped. As a rule at least two of the support belts 6 carry the car 2 and the counterweight 3. The support belts 6 are arranged adjacent to one another.

Figure 2:
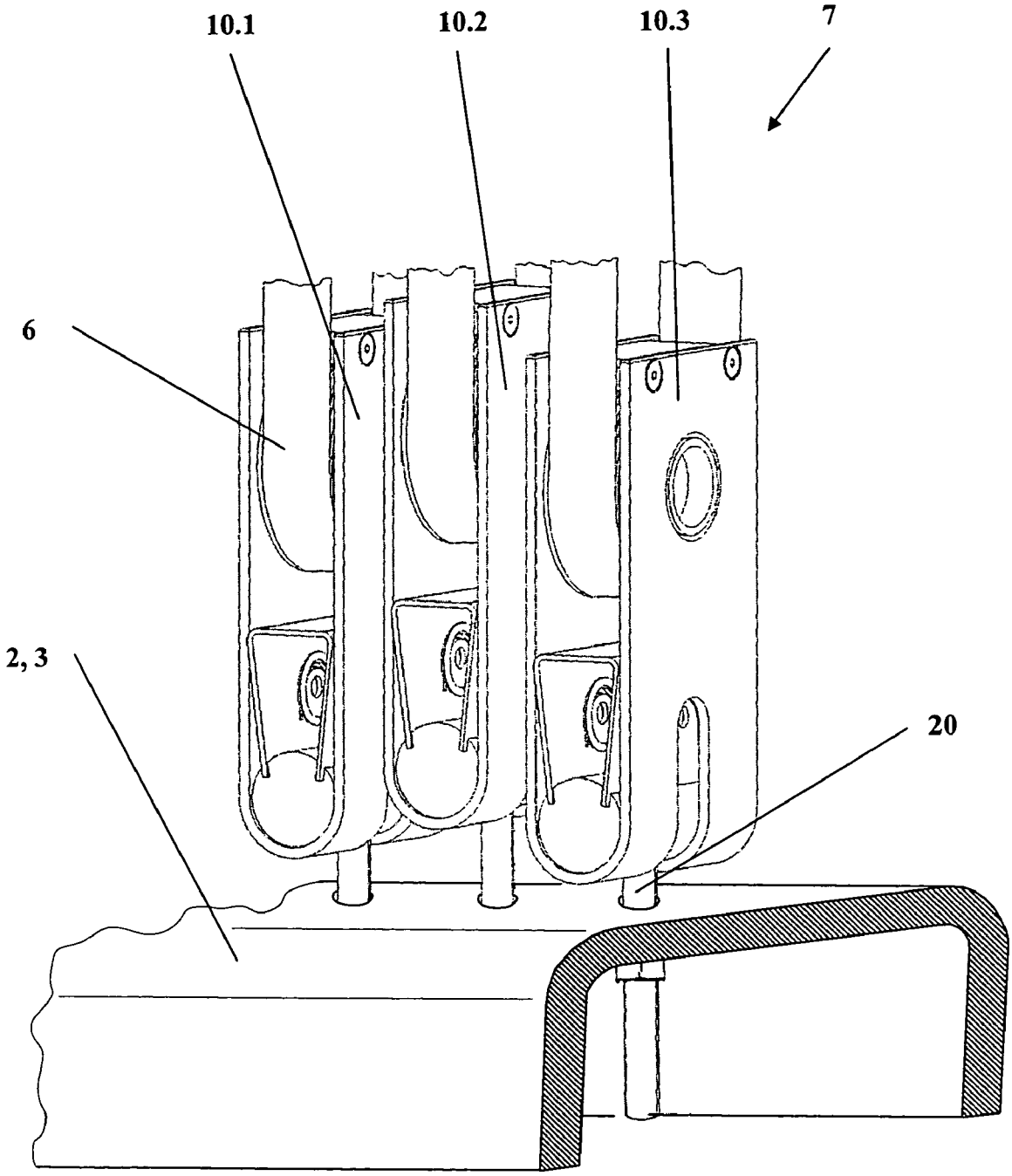
FIG. 2 is an enlarged perspective the suspension of the car shown in FIG. 1.

Equipment according to the present invention for suspension of the car 2 or the counterweight 3 is illustrated in FIG. 2. Several support belts 6—in the illustrated example, three support belts 6—are arranged in the immediate vicinity of one another. Each support means 6 is in that case according to the present invention connected with the car 2 or with the counterweight 3 by means of an associated deflecting roller unit 10. Direct vicinity means that no other parts are arranged between the support belts 6 such as serve for guidance, holding or fastening of the support means 6, inclusive of the necessary safety spacings. The advantage of this solution is that preparation of the deflecting roller unit 10 for a specific order is possible in a simple manner. A number of deflecting roller units 10.1, 10.2, 10.3 to be supplied is coordinated to the number of support belts 6 which are provided. Pre-assembly of the deflecting roller devices 10 specific to order is redundant. Moreover, the individual deflecting roller units 10 are individually rotatable and/or adjustable about an axis to a required take-off direction of the respective support belt. The spacing of the deflecting roller units 10 from the car 2 or from the counterweight 3 is adjustable, for example by threaded rods 20. Thus, the individual deflecting roller units 10 can be used for compensation for changes in length of the support belts 6. Length changes can result during the installing, for example, by reason of different support belt lengths, or they occur in operation, for example by reason of unequal loading of the support belts 6. The deflecting roller unit 10 according to the invention can also be used without limitation for elevator installations with a divided support belt arrangement.

Figure 4:
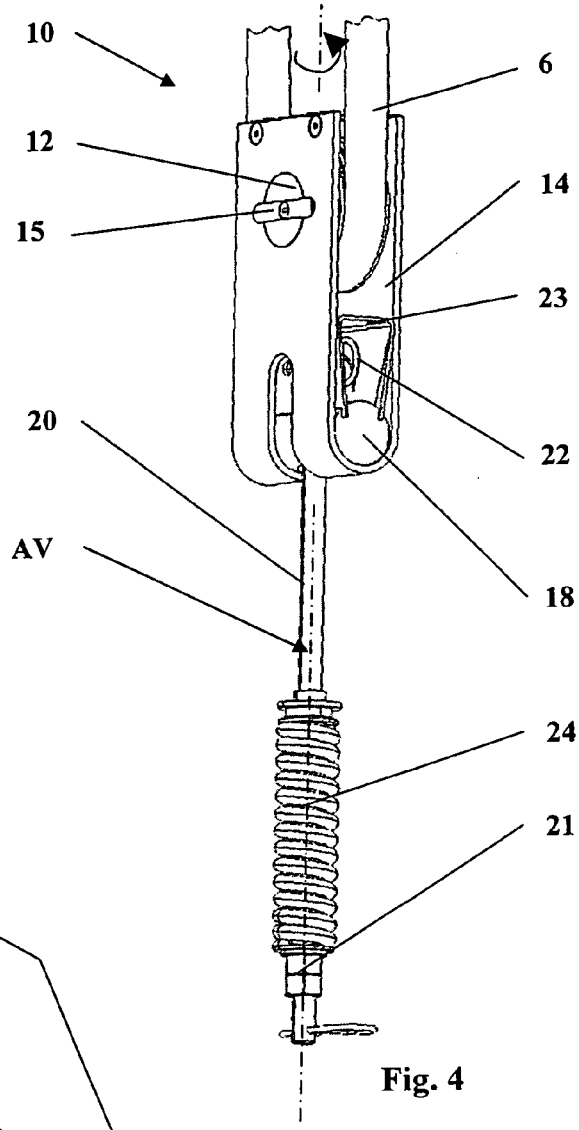
FIG. 4 is a perspective view of an alternate embodiment of the deflecting roller unit shown in FIG. 3 with a compensating spring according to the present invention.
Figure 3:
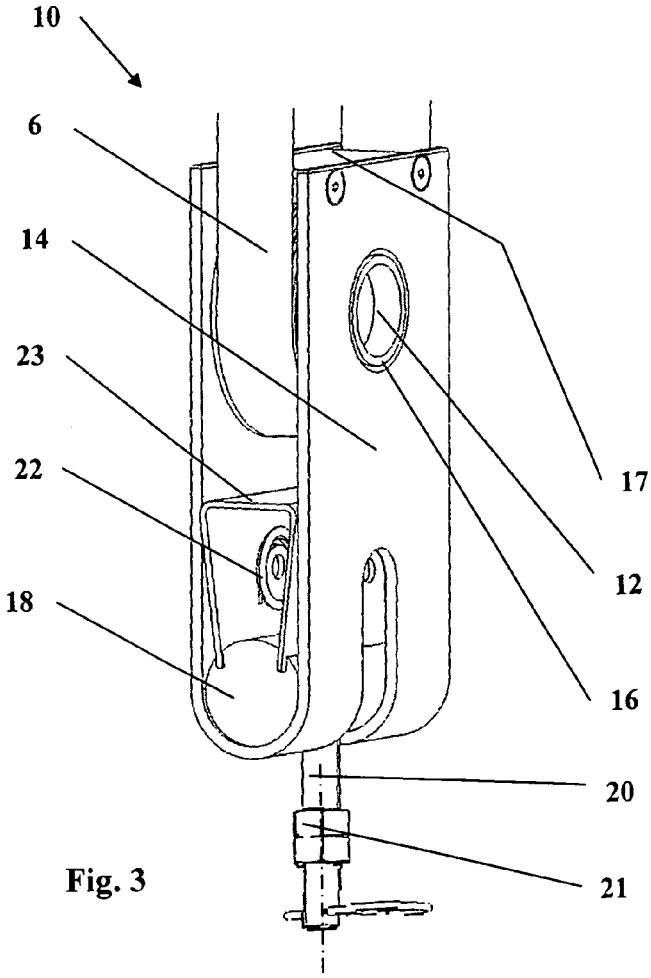
FIG. 3 is a perspective view of one of the deflecting roller units shown in FIG. 2.
Figure 5:
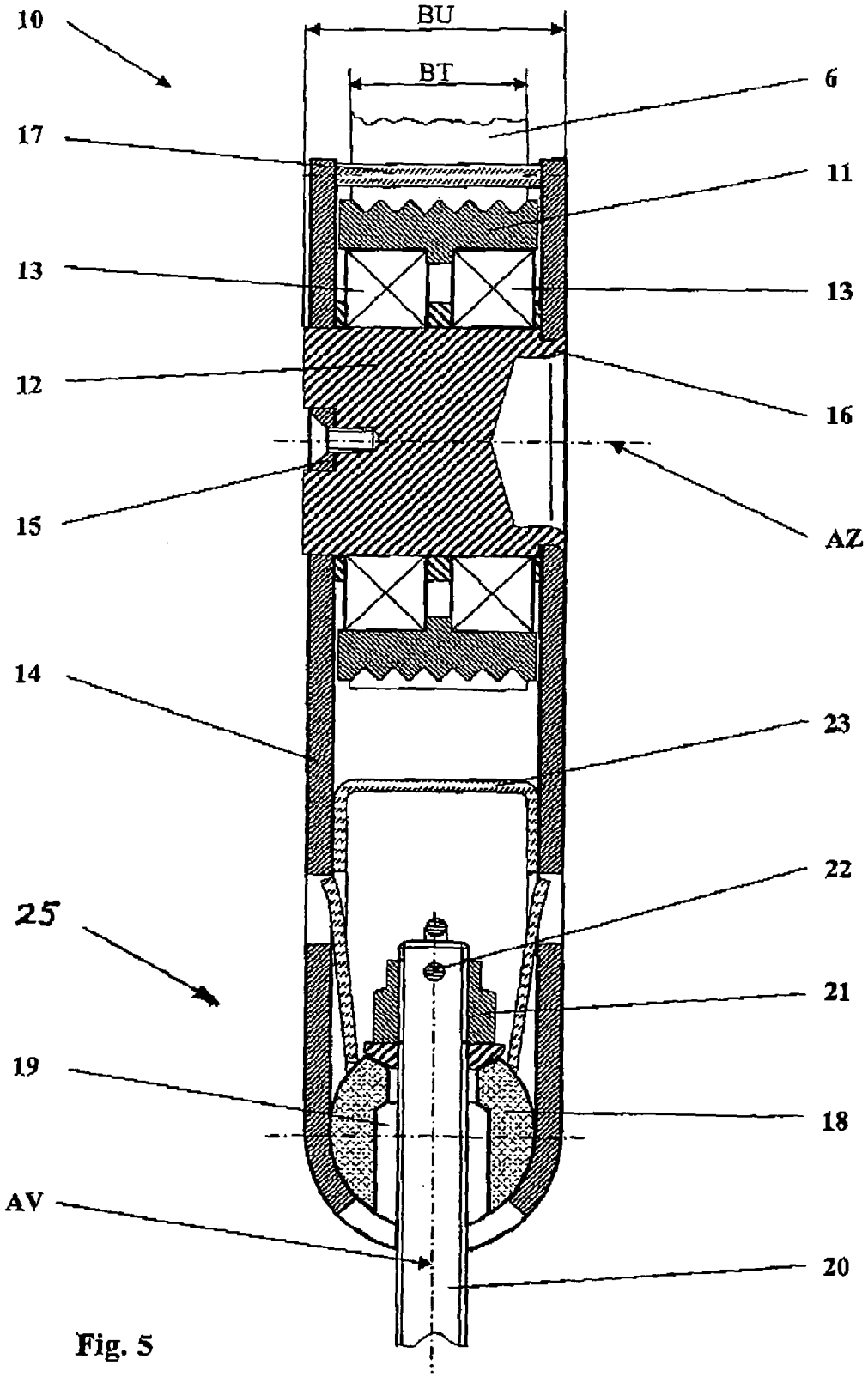
FIG. 5 is a cross-sectional view of the deflecting roller unit according to the present invention.

FIG. 3, FIG. 4 and FIG. 5 illustrate an advantageous form of embodiment of the deflecting roller unit 10 in detail. The deflecting roller unit 10 comprises a deflecting roller 11. The deflecting roller 11 is matched to a width BT of the support belt 6. The illustrated deflecting roller unit 10 thus offers space for exactly one of the support belts 6. This allows an optimum utilization of the space, since no unnecessary space is lost. The deflecting roller 11 is mounted on an axle 12, advantageously by means of roller bearings 13, and the axle 12 is connected with a U-shaped carrier 14, which laterally retains the deflecting roller 11. The axle 12 is in that case provided, for example at one end, with securing means 15 against turning and on the other side seals with the U-shaped carrier 14. The sealing takes place in that the axle 12 is provided with a shoulder and a flange 16, which is expanded to the U-shaped carrier 14. This embodiment is particularly space-saving and accordingly enables small spacings between adjacent deflecting roller units 10.1, 10.2, 10.3.

The support belt 6 engages the deflecting roller 11 usually with an angle of wrap of approximately 180°. A spacer 17 is arranged in the region of the deflecting roller 11 not embraced by the support belt 6. The spacer 17 can be of one-piece or multi-piece construction. The spacer 17 determines the spacing of the U-limbs, which are formed by the U-shaped carrier 14, at the side of the U-shaped carrier 14 which is open with respect to the U-shape and it prevents objects from dropping into the entry zone of the support belt 6.

The U-shaped carrier 14 forms a semicircular curve at its end opposite the spacer 17. This curve forms the receptacle for a cylinder 18 which has a transverse bore 19. A tie bolt 20 extends through the transverse bore 19 and is provided at its end facing the deflecting roller 11 with a nut 21, preferably a castle nut, and securing cotter pin 22. The tie bolt 20 represents the connection of the deflecting roller unit 10 with the car 2 or the counterweight 3. The deflecting roller unit 10 is adjustable about an axis AV defined by the tie bolt. The cylinder 18 arranged in the U-shaped carrier 14 forms a ball socket 25 and additionally enables adjustment of the deflecting roller unit 10 about the axis of the cylinder 18. In the illustrated embodiment the cylinder 18 is secured by means of a securing plate 23 against lateral slipping. The securing plate 23 at the same time prevents damage of the deflecting roller 11 by the tie bolt 20. The illustrated embodiment requires little space, can be manufactured economically and is appropriately adjustable to a take-off direction of the support belt 6.

The deflecting roller 10 is constructed in such a manner that the constructional width BU required by the deflecting roller unit 10 is less than 1.7 times the width BT of the support belt 6. The illustrated example offers space for a support belt 6 of approximately 30 millimeters width BT. The associated deflecting roller unit 10 requires a width BU of approximately 43 millimeters. A spacing of adjacent deflecting roller units 10 can be fixed at approximately 48 millimeters. Existing elevator installations with support cables usually have a support cable spacing of approximately 48 millimeters. The embodiment according to the present invention can thus be used particularly well for modernization of existing elevator installations. Existing connecting hole patterns of car and counterweight can be used. This is favorable in terms of costs, since the modernization interface is placed at an easily definable location.

The tie bolt 20 is secured to the end facing the deflecting roller 11 by the securing cotter pin 22, preferably a spring clip. This enables simple mounting and demounting of the deflecting roller unit 10 in the case of need.

The tie bolt 20 is, at the end of the tie bolt 20 at the car side or counterweight side, selectably executed with a fixed fastening or the fastening is adjustable. A fixed fastening can be a screw head, which transmits the supporting force of the support belt 6 to the car 2 or the counterweight 3. This fastening is advantageous when no space for more extensively adjustable fastenings is present.

An adjustable fastening is, as illustrated in FIG. 3, the tie bolt 20 with a thread, on which the threaded nut 21 with corresponding locking means and securing cotter pin is arranged, which transmits the supporting force from the support belt 6 to the car or the counterweight. Compensation for elongation of the support belt 6 is carried out in that the support belt 6 is tensioned or relaxed by means of the tie bolt 20 or by adjustment of the threaded nut 21 on the tie bolt 20. This is advantageous, since through this adjustment compensation can be provided for a substantial elongation of the support belt 6, as a change in length at the tie bolt 20 corresponds with twice the change in length of the support means 6. An adjustment of the tension of the support belt 6 by means of the tie bolt 20 is thus very space-saving.

Advantageously at least one of the support belt end fastening 9 or the deflecting roller unit 10 is executed with a spring-loaded bias. Compensation can thereby be provided for different degrees of stretching or elongation of several support belts 6 relative to one another during operation of the elevator installation 1. One embodiment of the fastening of the deflecting roller unit 10 proposes, as illustrated in FIG. 4, that a spring 24 arranged on the tie bolt 20 enables compensation for different stretching or elongation of the support belt 6.

In a preferred embodiment the tie bolt 20 is additionally pivotably fastened at both ends by way of a ball socket. The fastening leads at one end of the tie bolt 20 to the car or to the counterweight and at its other end to the cylinder 18 of the deflecting roller unit 10. This is advantageous, since the deflecting roller unit 10 can be adjusted in correspondence with a take-off direction of the support means 6 and the tie bolt 10 is thus substantially free of bending stresses.

The deflecting roller 11 is shaped in correspondence with a form of construction of the support belt 6. It has a smooth deflecting surface or a structure. In the case of need it is provided with lateral shoulders. The expert defines the construction in correspondence with requirements for traction, noise or guidance accuracy.

Figure 7:
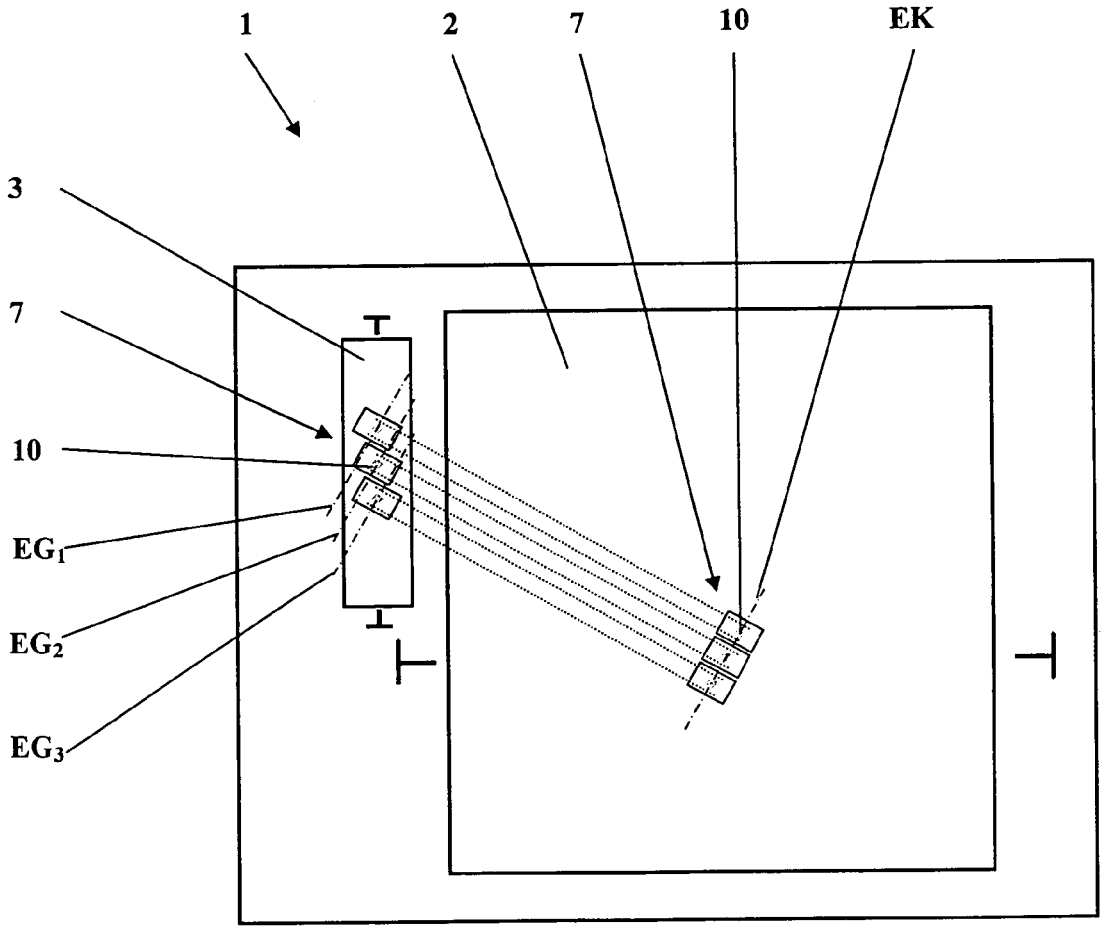
FIG. 7 is a schematic plan view of an example of an arrangement of deflecting roller units in an elevator installation.

FIG. 7 shows a further advantageous form of use of the equipment according to the invention. As a rule the centre axis AZ of the several deflecting rollers 11, which are arranged on the car 2 or the counterweight 3, are arranged on a vertical plane EK. This means that the axes 12 of several deflecting roller units 10 considered from above are arranged in a line. Considered from the side, the axes 12 can be set at different height levels, as is apparent in FIG. 2. In an alternative arrangement, however, the centre axes AZ of the deflecting rollers 11 are arranged on mutually parallel vertical planes $EG_1$, $EG_2$, $EG_3$. This means that the axes 12 of several deflecting roller units 10 considered from above are arranged to be displaced in parallel relative to one another. An inclined setting region, which in a normal case is achieved by an inclined setting of the common fastening of the deflecting roller units 10, can thereby be increased.

The deflecting roller unit 10 of the aforesaid kind can be used in particularly satisfactory manner for mounting suspension means in an elevator installation. A use of the deflecting roller 10 for this purpose is illustrated, by way of example, in FIG. 6.

A support belt 6.1 is in that case provided for mounting in the region of an uppermost shaft position, for example on the car 2, which is premounted in this region or fixed there, or in an engine room. Advantageously one end 6.2 of the support belt is placed over the drive unit.

The end of the support belt 6.2 is now moved into the deflecting roller unit 10 and the end of the support means 6.2 is connected by means of the support belt end fastening 9 with a fixing point at the counterweight side.

The support belt 6 is let down in the shaft, wherein the support belt 6 is moved downwardly by means of the weight of the deflecting roller unit 10 until the deflecting roller unit 10 has reached the counterweight 3 premounted in the region of the shaft pit.

When the deflecting roller unit 10 has reached the associated counterweight 3 the deflecting roller unit 10 is fastened at the corresponding fastening point. The loose end of the support belt 6 is moved into the associated deflecting roller unit 10, the deflecting roller unit 10 is fastened to the car 2 and is fastened by means of a further support belt end fastening 9 to the fixing point at the car side. The support belt 6 can in that case be shortened to the required support means length.

After mounting of all support belts 6 the support means tension can be set with the help of the tie bolt 20 or can be balanced between the support means 6.

The illustrated method is simple to manage, since no support means ends have to be pulled up through the elevator shaft, but the support belt 6 can always be mounted from above to below.

Figure 6:
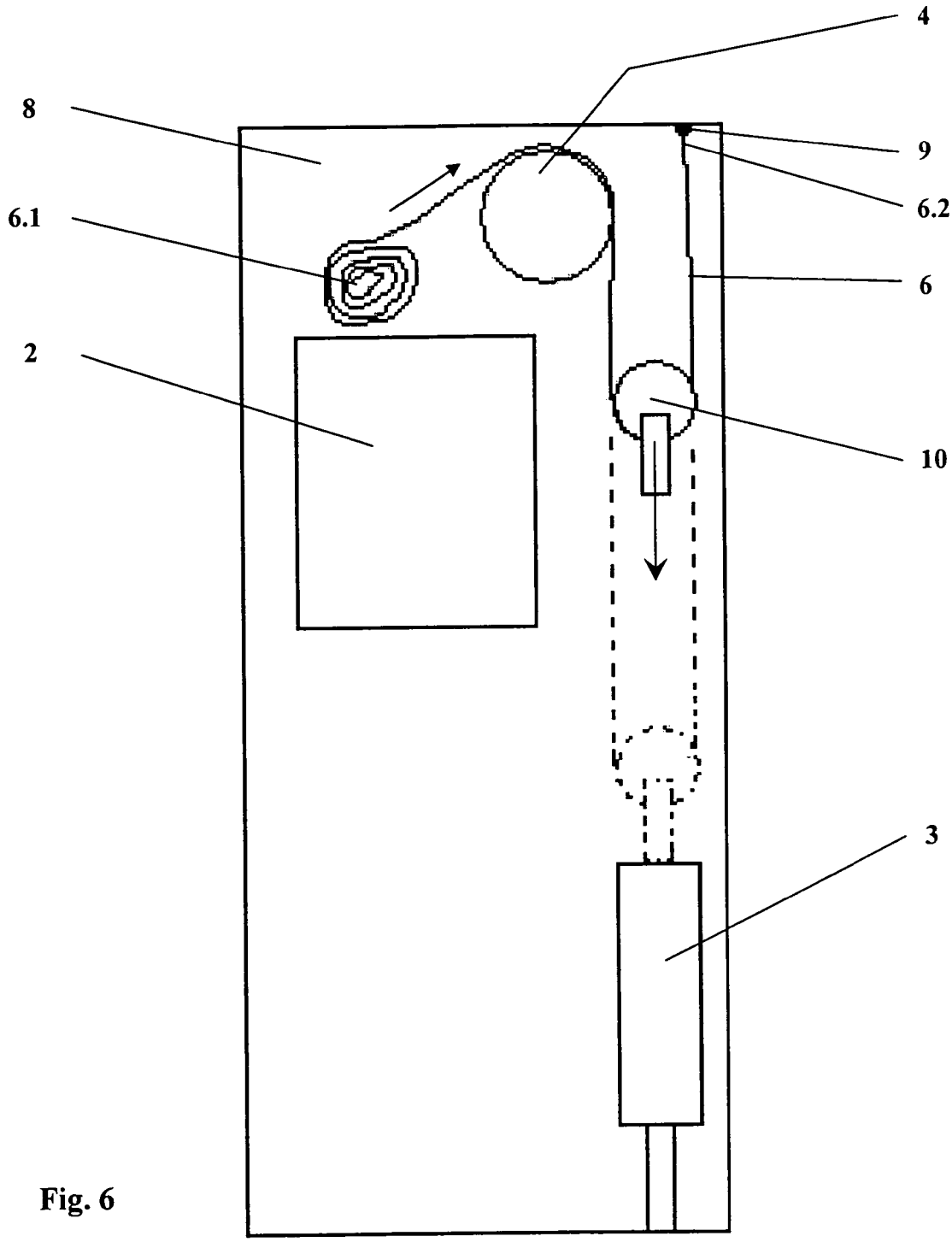
FIG. 6 is a schematic elevation view of an example of the mounting of a support belt according to the present invention.

If the car 2 is, as illustrated in FIG. 6, premounted in the vicinity of an uppermost stopping point or is fixed there within the scope of a modernization, the roof of the car 2 can be used as an excellent working platform. Mounting of auxiliary platforms is in that case redundant.

The expert will recognize further advantageous refinements of the outlined examples. Thus, for example, the expert uses individual side plates instead of the illustrated U-shaped carrier 14, changes the illustrated sequence when mounting the support belts or adapts the illustrated 2:1 looping suspension to multiple looping suspension, which requires for each support belt 6 several deflecting roller units 10 at the car 2 or at the counterweight 3. The equipment according to the present invention can obviously also be used as an individual deflecting roller unit at a desired location in the shaft.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for the suspension of a car or a counterweight in an elevator installation, herein the car or the counterweight hangs from at least two support belts and each support belt is connected with the car or the counterweight by at least one deflecting roller unit, each said deflecting roller unit comprising:

a deflecting roller sized to receive only one of the at least two support belts;

a carrier rotatably retaining only said deflecting roller; and fastening means for individual attachment of said carrier to one of the car and the counterweight wherein each said deflecting roller unit is rotatable about an axis transverse to an axis of rotation of said associated deflecting roller, and wherein said fastening means includes a tie bolt and said tie bolt is pivotally fastened at both ends with at least one of said ends being fastened by a ball socket to permit an adjustment of each one of said deflection roller units in correspondence with a take-off direction of a corresponding one of the support belts.

2. The equipment according to claim 1 wherein the support belts are arranged adjacent to one another and are received by respective ones of said deflecting roller units being arranged adjacent to one another and placed side by side, and wherein either a width of said carriers is less than 1.7 times a width of the support belts or a distance between adjacent ones of said carriers is less than a width of the support belts thereby permitting installation of said deflecting rollers when modernizing the elevator installation.

3. The equipment according to claim 2 wherein with said deflecting roller units being arrange adjacent one another center axes of said adjacent deflecting rollers attached to the car or the counterweight are one of arranged in a single vertical plane and arranged on individual vertical planes parallel to one another.

4. The equipment according to claim 1 wherein each said deflecting roller unit is adjustable about a longitudinal axial axis defined by said tie bolt.

5. The equipment according to claim 1 wherein each said deflecting roller is arranged on an axle and supported by roller bearings, said axle being incorporated in a U-shaped carrier and said U-shaped carrier being connected with said tie bolt by a cylinder, said tie bolt being secured to said cylinder by a cotter pin.

* * * * *